US008205854B2

(12) United States Patent
Brewka et al.

(10) Patent No.: US 8,205,854 B2
(45) Date of Patent: Jun. 26, 2012

(54) FORM CLAMP

(75) Inventors: Roman Brewka, St. Joseph, MO (US); Ronald A. Ward, Leawood, KS (US); Donald G. Peacock, Peachtree City, GA (US)

(73) Assignee: Western Forms, Inc., Kansas City, MO (US)

( * ) Notice: Subject to any disclaimer, the term of this patent is extended or adjusted under 35 U.S.C. 154(b) by 535 days.

(21) Appl. No.: 12/401,487

(22) Filed: Mar. 10, 2009

(65) Prior Publication Data

US 2009/0230283 A1 Sep. 17, 2009

Related U.S. Application Data

(60) Provisional application No. 61/035,346, filed on Mar. 10, 2008.

(51) Int. Cl.
*E04G 9/00* (2006.01)

(52) U.S. Cl. ..... 249/196; 249/47

(58) Field of Classification Search ..... 249/44–47, 249/191–196, 219.1
See application file for complete search history.

(56) References Cited

U.S. PATENT DOCUMENTS

| | | | | | |
|---|---|---|---|---|---|
| 874,151 | A * | 12/1907 | Zeiser | ..... | 269/43 |
| 1,593,610 | A * | 7/1926 | White | ..... | 249/48 |
| 1,687,976 | A * | 10/1928 | Ford | ..... | 269/117 |
| 3,182,948 | A * | 5/1965 | Lawrence | ..... | 249/18 |
| 3,550,898 | A * | 12/1970 | Citrullo et al. | ..... | 249/195 |
| 4,529,163 | A * | 7/1985 | Dingler | ..... | 249/192 |
| 4,708,315 | A | 11/1987 | Carlson et al. | | |
| 4,744,541 | A | 5/1988 | Carlson et al. | | |
| 4,881,716 | A * | 11/1989 | Dingler | ..... | 249/192 |
| 4,958,800 | A | 9/1990 | Carlson | | |
| 4,976,401 | A | 12/1990 | Carlson | | |
| 4,978,099 | A | 12/1990 | Carlson | | |
| 5,058,855 | A | 10/1991 | Ward | | |
| 5,080,321 | A | 1/1992 | Carlson | | |
| 5,174,909 | A | 12/1992 | Ward | | |
| 5,184,439 | A | 2/1993 | Ward | | |
| 5,288,051 | A | 2/1994 | Ward | | |
| 5,713,687 | A * | 2/1998 | Schworer | ..... | 403/49 |
| 5,759,429 | A * | 6/1998 | Trimmer et al. | ..... | 249/196 |
| 5,965,053 | A | 10/1999 | Carlson | | |
| 6,767,154 | B1 * | 7/2004 | Schwoerer | ..... | 403/105 |
| 6,935,607 | B2 | 8/2005 | Ward et al. | | |
| 7,144,530 | B2 | 12/2006 | Ward et al. | | |
| 7,648,306 | B2 * | 1/2010 | Schworer | ..... | 403/373 |
| 2006/0208152 | A1 * | 9/2006 | McCracken | ..... | 249/192 |
| 2008/0017783 | A1 * | 1/2008 | Vanagan | ..... | 249/192 |

* cited by examiner

*Primary Examiner* — Darnell Jayne
*Assistant Examiner* — Timothy M Ayres
(74) *Attorney, Agent, or Firm* — Hovey Williams LLP

(57) ABSTRACT

A form clamp particularly useful in construction environments for clamping two side-by-side forming panels is provided. The form clamp includes a frame having a first jaw and a slider having a second jaw opposed to the first jaw. The slider is shiftable along the frame, and at least one includes a locating pin configured for receipt in holes in forming panels.

7 Claims, 14 Drawing Sheets

FORM CLAMP

This application claims the benefit of U.S. Provisional Application Ser. No. 6061/035,346 filed Mar. 10, 2008, the entire disclosure of which is incorporated herein by reference.

BACKGROUND OF THE INVENTION

1. Field of the Invention

A clamp useful for connecting two articles, preferably metal forming panels used for forming concrete, is provided which includes a frame having a first jaw and a slider having a second jaw. The slider may be fixed relative to the frame by a wedge inserted to engage and hold the jaws fast against one or more members to be clamped, or in an alternative embodiment alternatively by an arm which uses a camming action hold the jaws in position.

2. Description of the Prior Art

Forming panels of steel or aluminum are of used for casting walls and other parts of a building of concrete or other cementatious material. These forming panels are often placed side-by-side or at angles to make up a forming wall, and two forming walls are placed in opposition to provide a concrete-receiving channel. Concrete is poured into the channel, allowed to cure to a self-sustaining condition, and the forming panels are then removed and reused. Such forming systems are generally shown and described in U.S. Pat. Nos. 4,708,315, 4,744,541, 4,958,800, 4,976,401, 4,978,099, 5,058,855, 5,080,321, 5,174,909, 5,184,439, 5,288,051, 5,965,053, 6,935,607 and 7,144,530, the entire disclosures of which are incorporated herein by reference.

Various methods are used to hold forming panels in position. Opposing forms are often connected by tie bars and tie rods. Many forming panels include frames having side rails with holes. When the holes are aligned, pins and wedges are frequently used to hold together adjacent forms. The pins typically have a shank with a slot extending diametrically through the slot. After the pin is inserted through the holes, a wedge is inserted in the slot and hammered into place to hold the pin in position and the adjacent forming panels in side-by-side adjacency. Other fasteners, such as, for example, latching bolt assemblies such as those shown in U.S. Pat. No. 5,058,855, the entire disclosure of which is incorporated herein by reference, are also used to connect various forming panels.

However, circumstances may arise when the use of pin-type connections are not appropriate. For example, it may be necessary to temporarily couple two forming panels which do not have holes in their side rails. It may arise that the holes in the side rails cannot be aligned, or that a pin-type connection is otherwise not desired. For these reasons, a need has been developed for an alternate type of coupler useful for holding together two forming panels in side-by-side orientation.

SUMMARY OF THE INVENTION

The form clamp of the present invention largely meets these needs in providing a rugged clamp useful where soil, hardened concrete, and impact by metal objects may be encountered. The wedge form clamp hereof can be attached to forms quickly and tightened to hold two articles together. The form clamp includes a frame and a slider shiftable relative to the frame, each of the frame and slider having a jaw for engaging respective members to be clamped, and at least one of the frame and slider preferably including a locating pin which is configured and positioned for insertion into a hole in a form. In one embodiment, the clamping force is applied by the use of a wedge driven into place to hold two jaws fast against the rails or other adjacent parts of the form. In another embodiment, a clamping lever is pivotally mounted to the slider to urge the frame and slider together through a camming action and then locks the slider in position.

In one embodiment, the form clamp of the present invention includes a frame having a first jaw, a slider having a second jaw shiftably received by the frame, and a wedge which is received to engage the frame and the slider and hold the jaws fast against the object to be clamped. In this embodiment, the frame and slider are preferably held and drawn together by the novel and unexpected use of racks which are located internally on each of the frame and the slider. Each rack has a plurality of teeth. The racks are opposed and the teeth of the rack on the frame preferably have a pitch which is different than the teeth of the rack on the slider. The wedge preferably is somewhat Z-shaped in cross-section, and has a first flange which is angled to lie in a first plane which is convergent with a second plane in which the second flange is oriented. Because the first flange is angled relative to the second flange, when the wedge is driven, the teeth of one rack are held stationary while the teeth of the other rack are shifted, thereby shifting the jaw corresponding thereto. The wedge thus serves to move the frame and slider relative to one another and holds the clamp in position. The wedge is quickly removed by a hammer stroke from the opposite direction to dislodge the flanges from engagement and allow the frame and slider to separate.

In a second embodiment, a camming lever is mounted to the frame by a pivot pin which also serves to retain the slider in a slot in the frame. In this way, the frame, slider and camming lever and retained as a unit which helps to avoid separation of components in or after use. The slider can be shifted along the slot to increase the distance between the jaws for placement of the clamp. Once positioned, preferably with a locating pin of one of the jaws received in a hole in the forming member, the jaws are closed and the lever, which is provided with a camming head complementally configured with a recess in the slider, is pivoted to force closure between the two jaws.

In both embodiments, the frame and slider are preferably complementally configured so that the frame acts as a guide for the slider. The frame may be provided of a plurality of side-by-side leaves which are welded together or held by rivets or other similar fasteners. The clamps may be economically constructed of stamped metal pieces riveted together, or of cast or forged components when greater strength is desired.

These and other advantages of the wedge form clamp will be readily understood by those skilled in the art with reference to the drawing and the description which follows.

DESCRIPTION OF THE PREFERRED EMBODIMENTS

Figure 1:
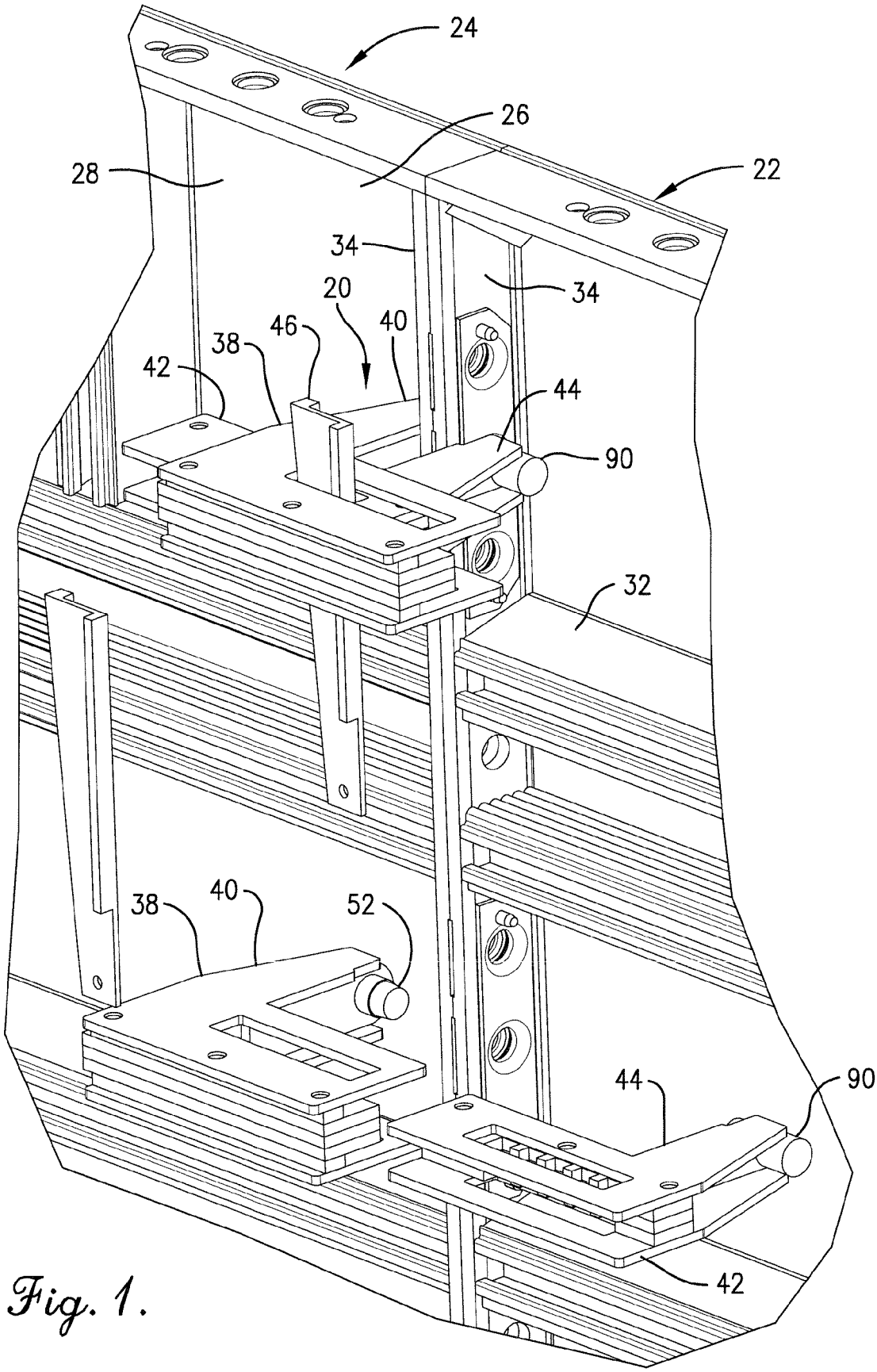
FIG. 1 is a fragmentary perspective view of two forming panels having side rails lying adjacent to one another and showing one wedge form clamp of the present invention positioned in clamping engagement with the forming panels and the frame and slider elements of another wedge form clamp in an exploded condition.

Referring now to the drawing, a form clamp 20 in accordance with the present invention is particularly useful for releasably clamping together two metal forming panels 22 and 24 used to provide at least a part of a forming wall used for receiving concrete thereagainst. The forming panels typically include a face plate 26 having a back side 28 and a front or concrete-receiving side 30, which is secured by welding, adhesive or fastening elements to a frame 32 including rearwardly extending rails 34 such as end rails or side rails. The frame 32 supports and in part protects the face plate 26. As shown in FIG. 1, the rails 34 may include holes 36 which, when two holes are aligned, may receive a pin or the like therethrough. The form clamp 20 is used to clamp two such forming panels together and broadly includes a frame 38 having a first jaw 40, a slider 42 having a second jaw 44, and a wedge 46. The slider 42 is received by the frame 38 for slidable movement therealong, and the wedge 46, when placed as shown in the drawings, serves to draw the jaws 40 and 44 together and hold them in position.

The frame 38 is shown in greater detail in FIGS. 5, 7, 8, 10, 11, 12 13 and 14, and includes a base 48, the first jaw 40 including a leg 50 and a locating pin or anvil 52. The frame 38 may be cast, forged or otherwise formed, but in the illustrated embodiment hereof, is constructed of laminated metal plates such that the frame 38 includes side plates 54 and 56 having leaves 58, 60 and 62 received therebetween. The side plates and leaves are preferably connected by pins 64 which are welded in place, but alternatively rivets or other fasteners may be used. The side plates 54 and 56 each have a window 66 in the base portion 48 which is surrounded by material. The leaves 58, 60 and 62, which may also be provided as a single unitary member, form a first rack 68 having a plurality of teeth 70 thereon. The teeth 70 of first rack 68 are spaced apart, most preferably at a regular first interval or first pitch, and it is to be understood that each of the leaves 58, 60 and 62 are substantially the same with their respective teeth each being in alignment. As may be seen in FIG. 8, slides 72 and 74, which are substantially identically configured, are positioned outboard of leaves 58 and 62 and thus between rack 68 and side plates 54 and 56. Each of the side plates 54 and 56, leaves 58, 60 and 62 and slides 72 and 74 include holes 76 which are aligned and sized to receive pins 64 therethrough. The leaves and slides define the interior dimension between the side plates 54 and 56.

Figure 3:
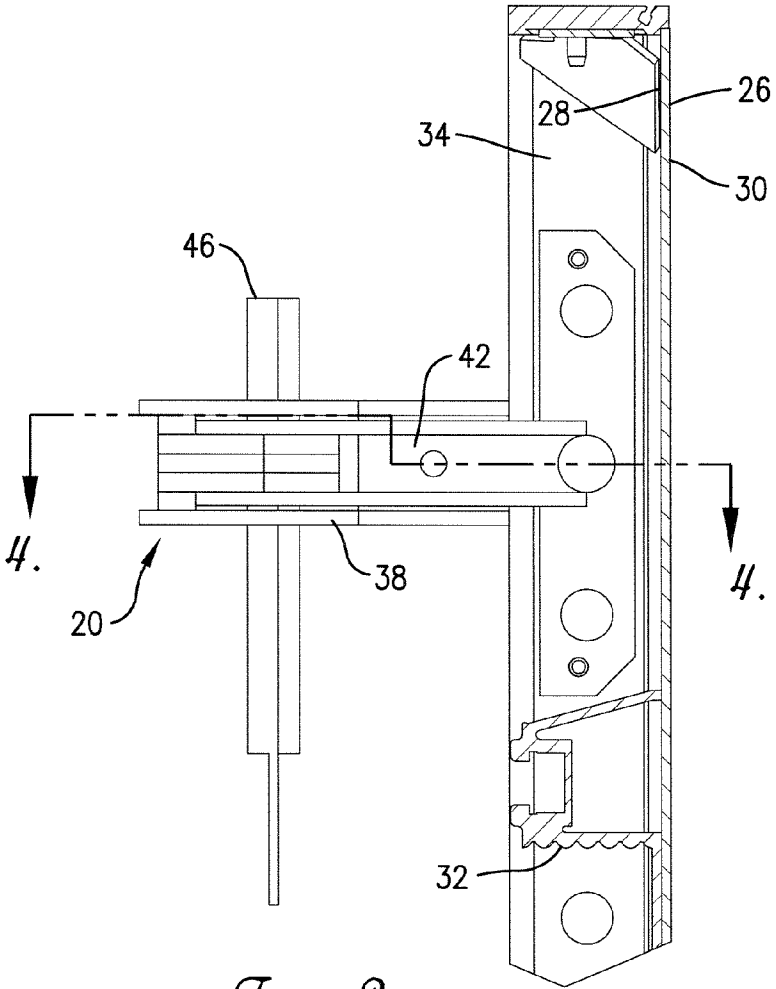
FIG. 3 is a fragmentary right side view showing the wedge form clamp of FIG. 2 in elevation and a fragmentary part of one of the forming panels in partial vertical cross-section.
Figure 2:
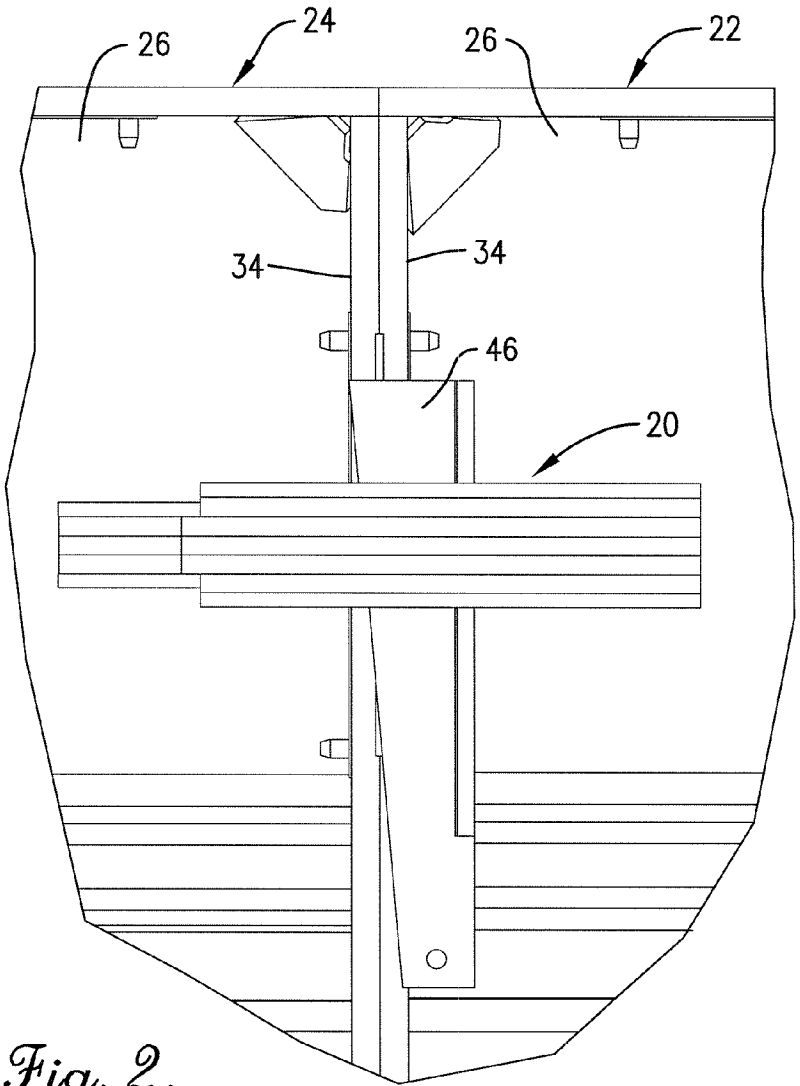
FIG. 2 is a fragmentary rear elevational view of the forming panels and engaged wedge form clamp shown in FIG. 1.
Figure 4:
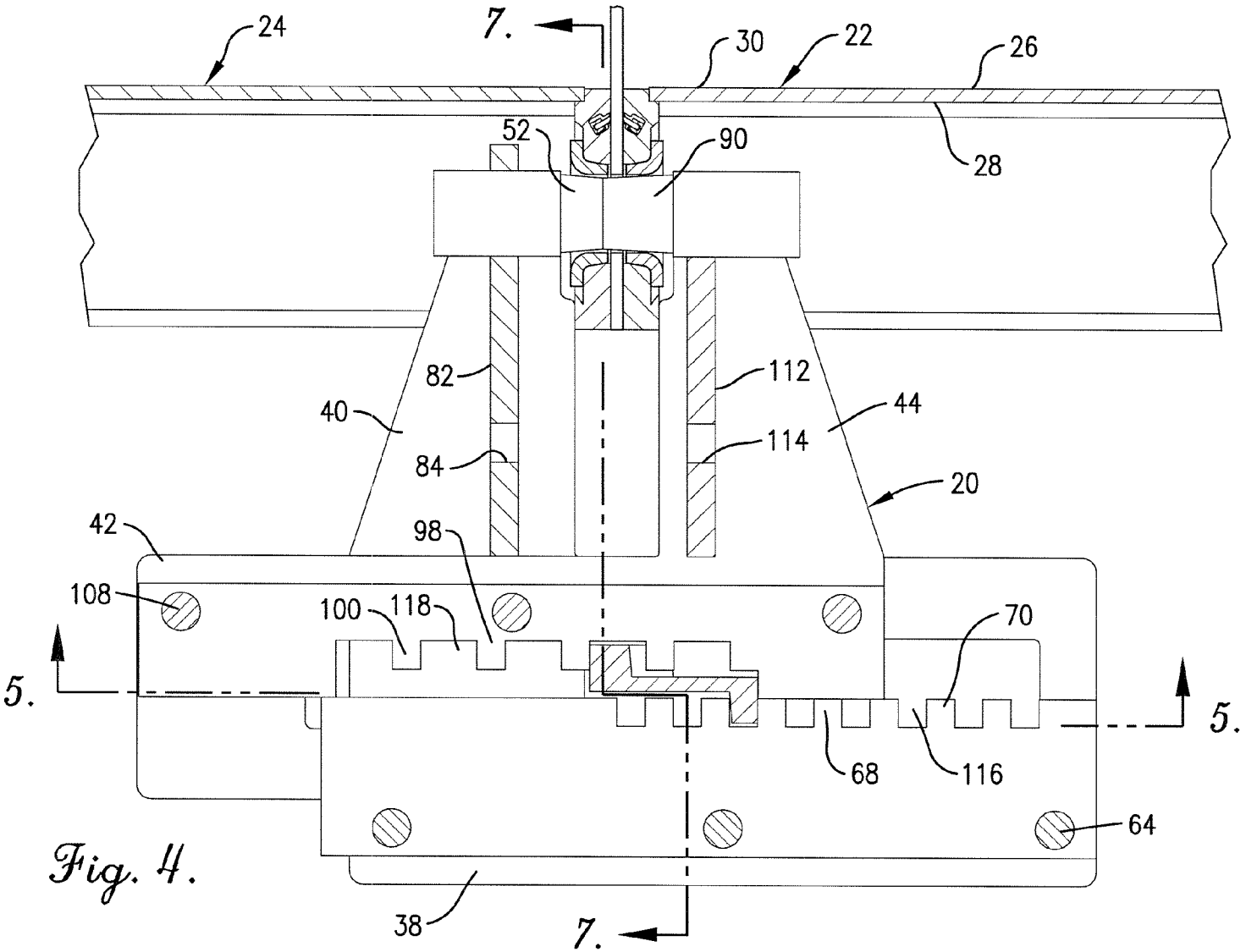
FIG. 4 is an enlarged, fragmentary cross-sectional view taken along line 4-4 of FIG. 3 showing the first and second jaws passing through a hole in the side rails of two adjacent forming panels.
Figure 5:
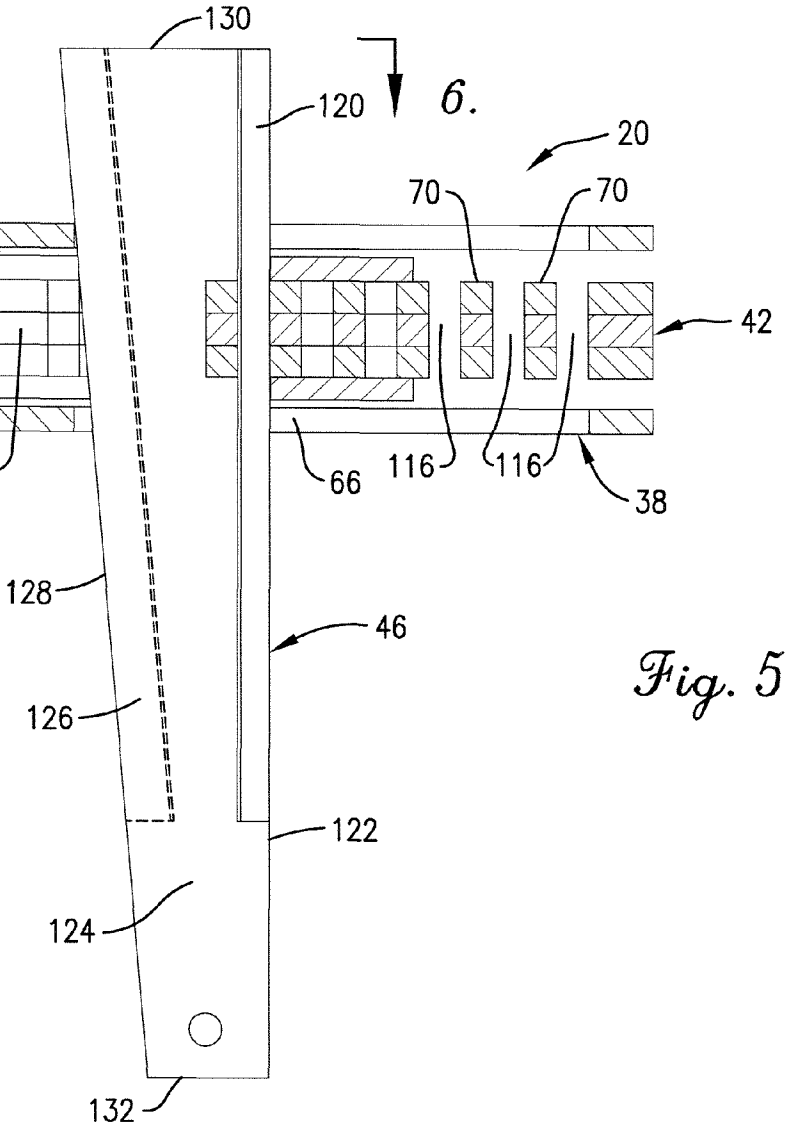
FIG. 5 is an enlarged, fragmentary cross-sectional view taken along line 5-5 of FIG. 4, showing one flange of the wedge in solid lines and a second flange in dashed lines to indicate the convergent orientation of the flanges to bring the teeth of the rack of the frame and the teeth of the rack of the slider closer together.

First jaw 40 includes the leg 50 and the anvil 52. The leg 50 of frame 38 extends substantially perpendicular from the base 48 and includes extensions 78 and 80 from the side plates 54 and 56 and crossmember 82. The crossmember 82 is spaced from the slides 72 and 74 and presents an edge 74 opposite the anvil 52 which helps to avoid undesired dislodgement of the slider 42. The crossmember 82 also includes an opening 84 which extends through the crossmember and provides a site for attachment of form hardware, wires, etc. as desired. The anvil 52 is typically aluminum alloy or steel and welded or otherwise secured to the crossmember. While the anvil 52 may be of other configurations or dimensions, advantageously it is substantially circular in cross-section and sized for receipt through one of the holes 36, so that the anvil 52 may extend through a hole as shown in FIGS. 3 and 4, or simply hold a portion of the side rail.

Figure 9:
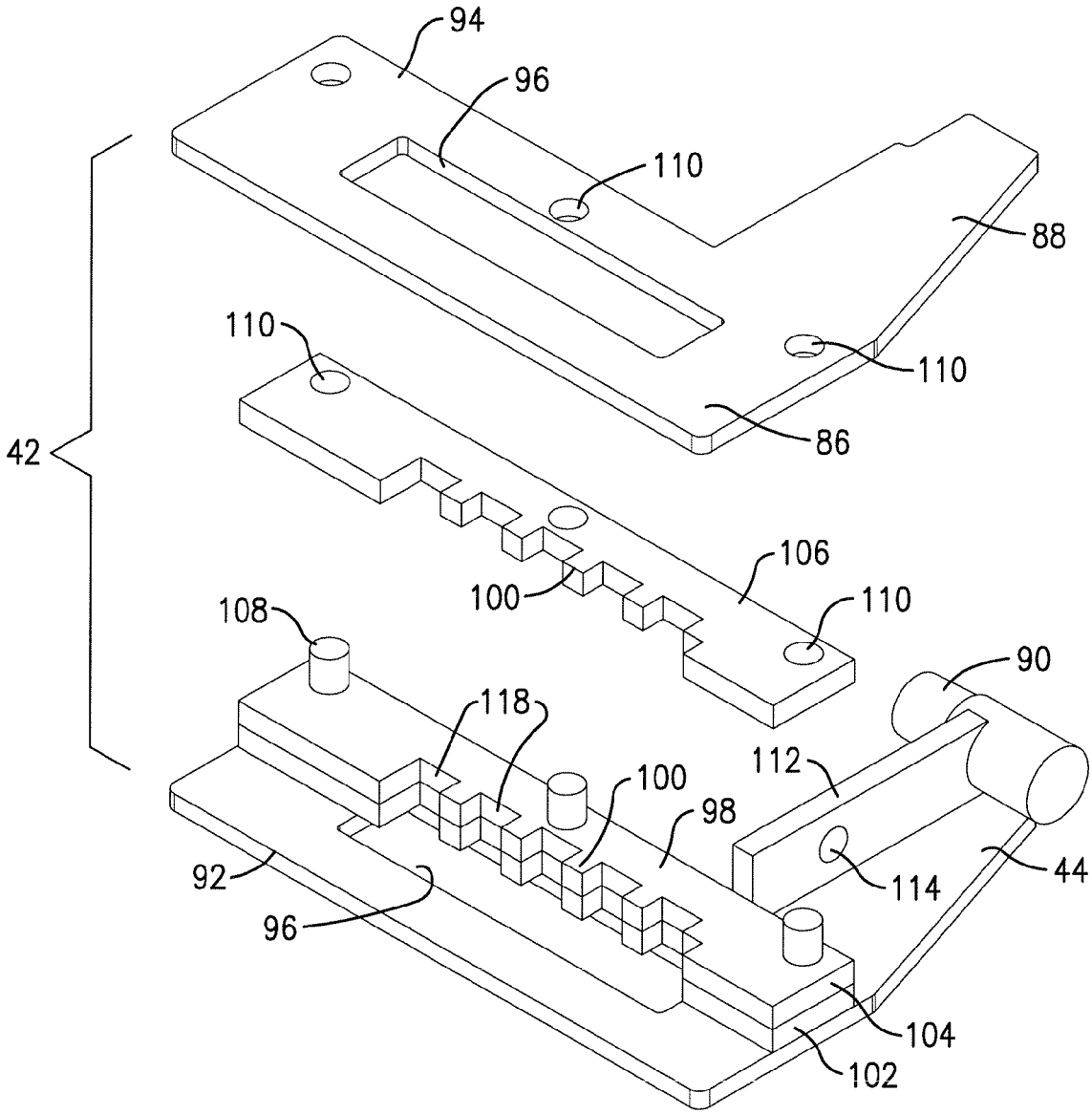
FIG. 9 is an enlarged exploded view of the slider of the wedge form clamp hereof.
Figure 10:
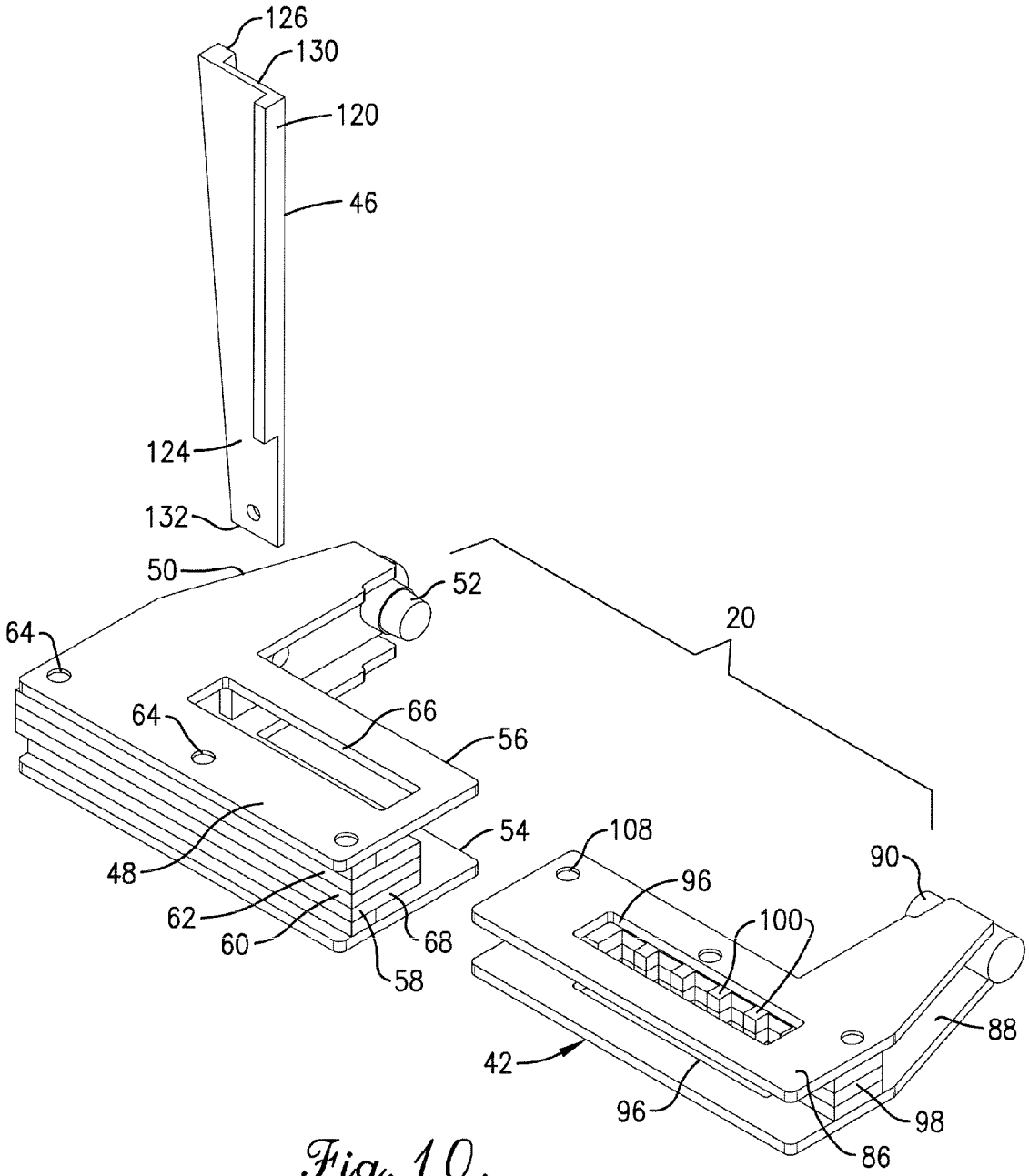
FIG. 10 is an enlarged exploded view of the wedge form clamp hereof showing the frame, slider and wedge separated from one another.
Figure 11:
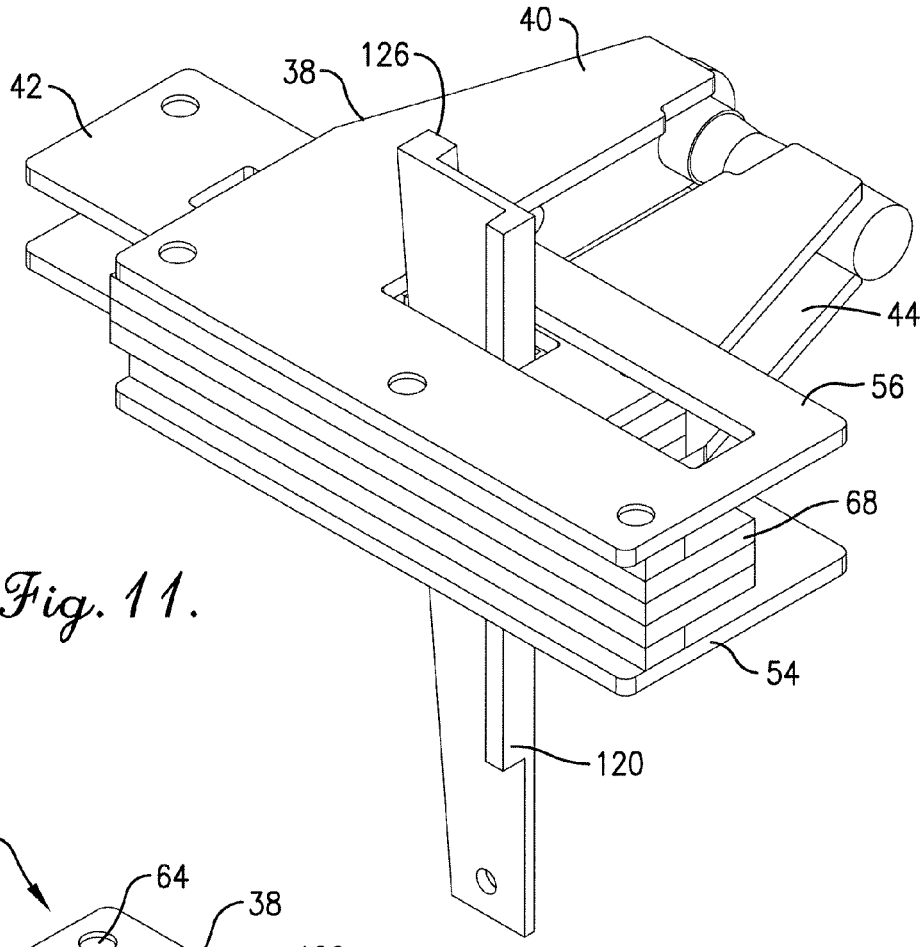
FIG. 11 is an enlarged perspective view taken from the base side of the frame of the wedge form clamp hereof showing the wedge holding the frame and slider.
Figure 12:
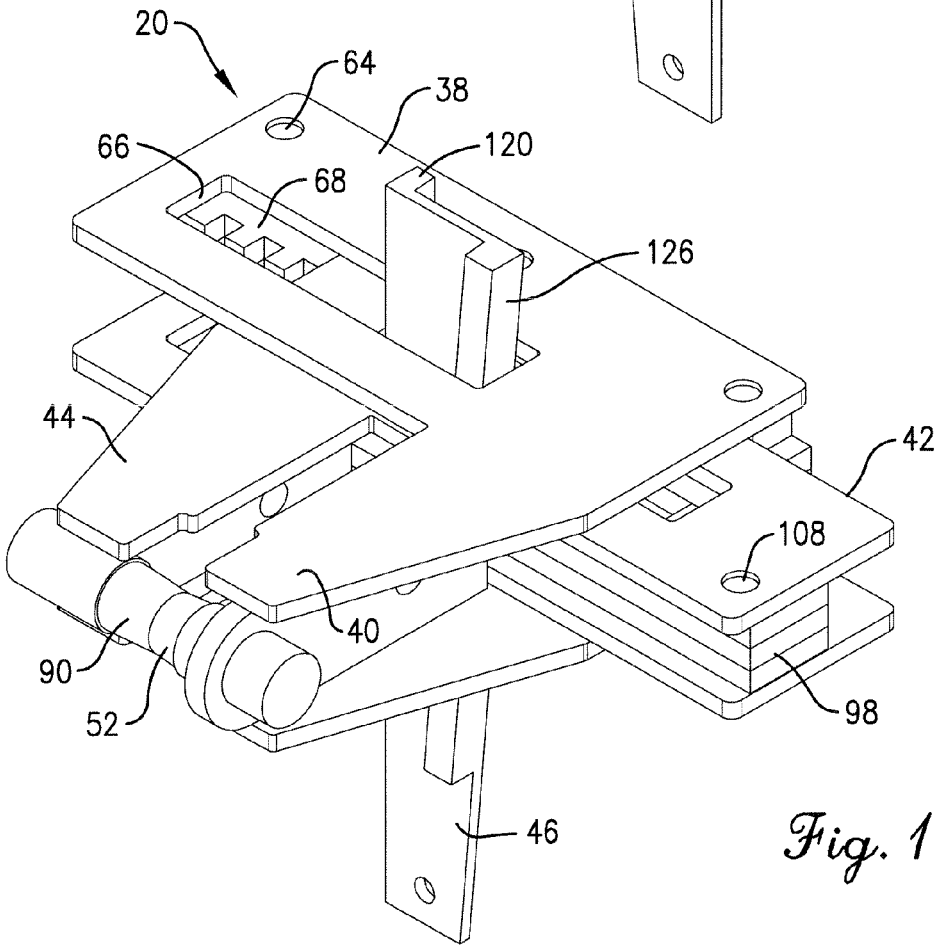
FIG. 12 is an enlarged perspective view taken from the jaws side of the frame of the wedge form clamp hereof showing the wedge holding the frame and slider.
Figure 13:
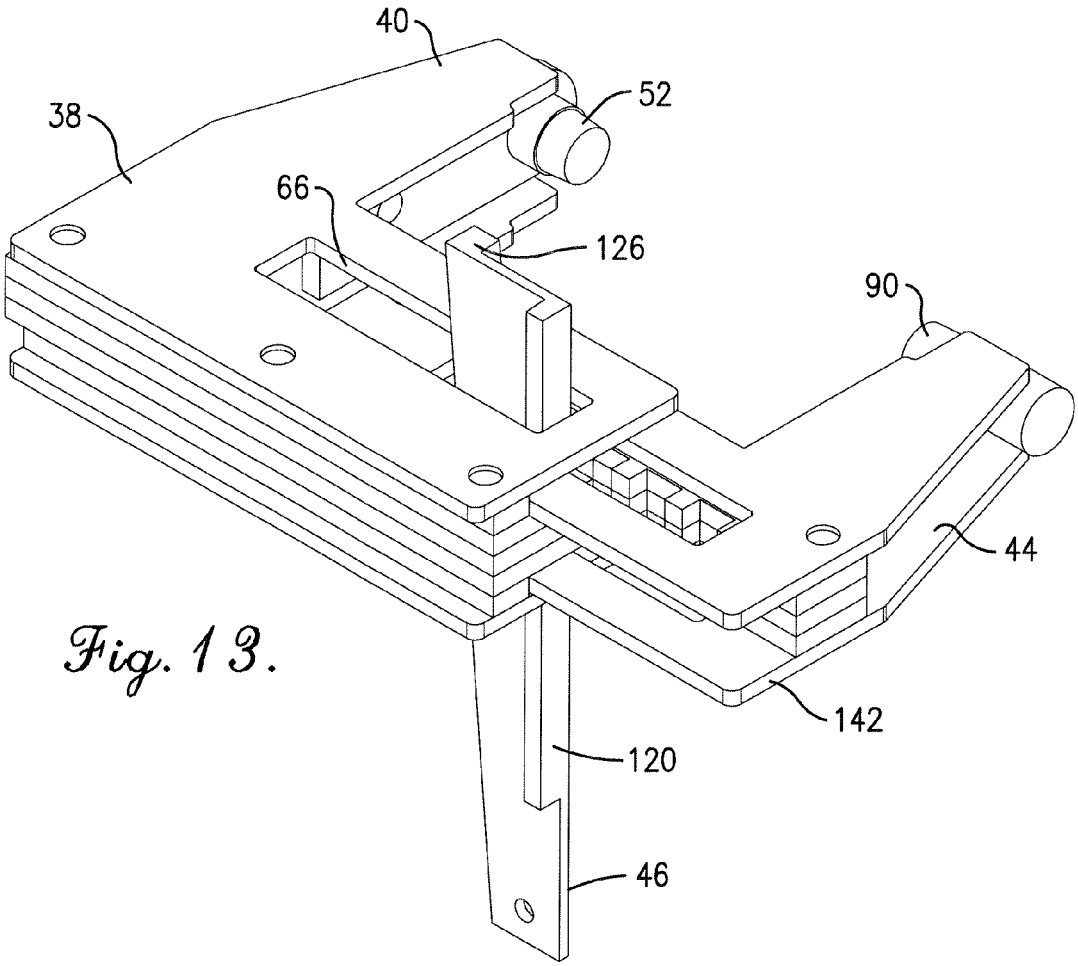
FIG. 13 is an enlarged perspective view similar to FIG. 11 but showing the jaws in a separated position.

The slider 42 is constructed to be complemental to the frame 38 and to be received between the side plates 54 and 56 for slidable movement along the slides 72 and 74. Slider 42 includes a base 86, an arm 88 and a head or locating pin 90, the arm 88 extending a distance from the base 86 to position the locating pin 90 opposite the anvil 52. The arm 88 and the locating pin 90 being included in the second jaw 44. The base 86 includes side panels 92 and 94, each having a window 96 therethrough with the windows 96 of each side panel 92 and 94 being in registry. The slider 42, as better seen in FIGS. 9 and 10, also includes a second rack 98 having a plurality of teeth 100 spaced apart at a second interval or pitch which is preferably different than the first pitch of the teeth of rack 68. The teeth 100 of second rack 98 are oriented to be opposite, and facing, the teeth 70 of the first rack 68 when the wedge 46 is inserted. The teeth 100 are accessible through the windows 96. The second rack 98 includes leaves 102, 104 and 106 which are substantially the same in size and configuration and connected such that their teeth are aligned with each other to provide a rack 98 of commonly spaced and configured teeth 100. Pins 108 extend through holes 110 in each of the leaves and side panels 92 and 94 and are welded to hold the side plates 54 and 56 and leaves 102, 104 and 106 together.

The second jaw 44 includes the arm 88 and the head or locating pin 90. The arm 88 includes extensions from the side panels 92 and 94 and brace 112 which includes a hole 114 therethrough, the hole 114 being positioned opposite and in registry with the opening 84. The head or locating pin 90 is preferably of steel or aluminum alloy and positioned to extend from the arm 88 opposite the anvil of the first jaw 40 so as, like the anvil which projects from the leg, to project from the arm such that the head and the anvil meet when drawn together. The leaves 102, 104 and 106 have a thickness which is the same as the thickness of the leaves 58, 60 and 62, so that when the frame and slider are brought together, they interfit with the frame 38 receiving the side panels 92 and 94 on slides 72 and 74, the side panels 92 and 94 being received between the side plates 54 and 56. Because the first rack 68 has a thickness the same as the second rack 98, they lie in opposition to one another with their teeth oriented in opposition, but not matching because of the different pitches, so that the gaps 116 between teeth 70 are not consistently aligned with the gaps 118 between the teeth 100.

Figure 6:
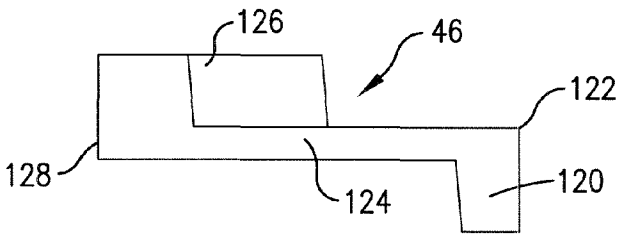
FIG. 6 is a top plan view taken along line 6-6 of FIG. 5 showing the wedge.
Figure 7:
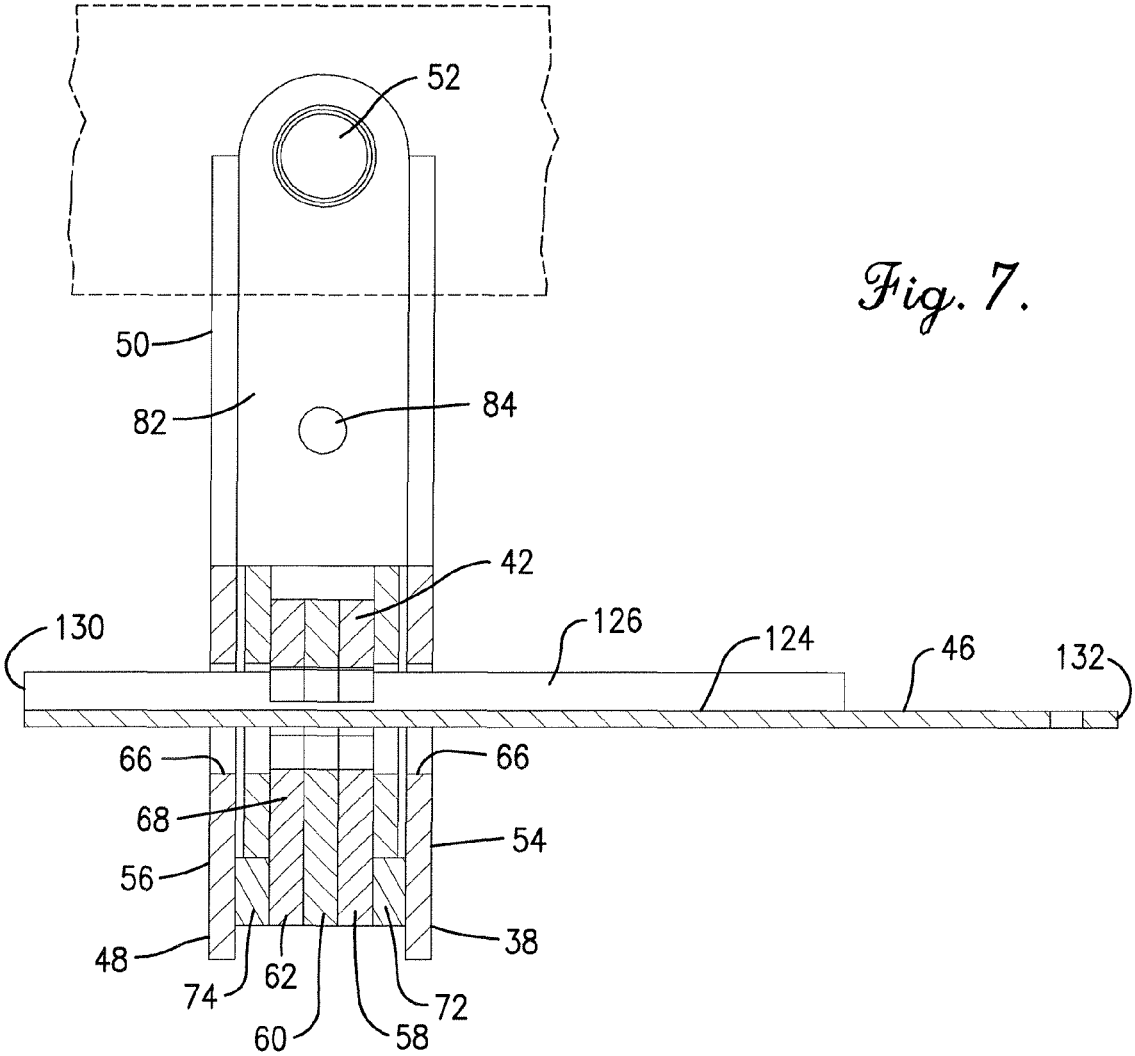
FIG. 7 is an enlarged vertical cross-sectional view taken along line 7-7 of FIG. 4 showing the relative positions of the frame and the slider.
Figure 8:
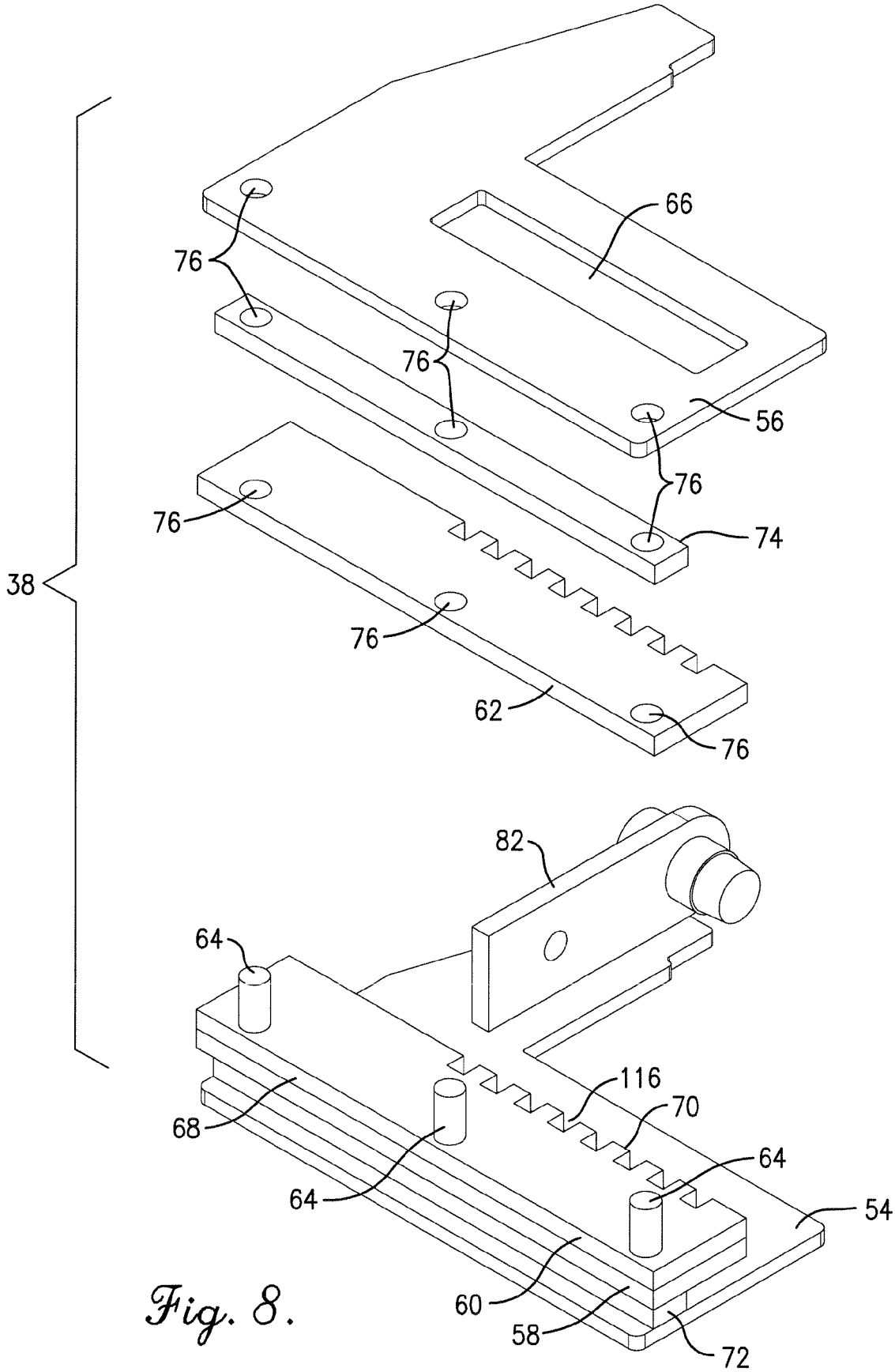
FIG. 8 is an enlarged exploded view of the frame of the wedge form clamp hereof.

The wedge 46 is somewhat Z-shaped in cross section, and is elongated having a first flange 120 extending perpendicular from and along one edge 122 of a central body 124. A second flange 126 extends opposite to the first flange 120 and is perpendicular to another edge 128 of the central body 124. As may be best seen in FIGS. 5 and 6, the first flange 120 and the second flange 126 are in convergent planes; that is to say, because they extend in opposite directions from the central body 124, the flanges 120 and 126 do not themselves converge, but they lie in planes which converge. The transverse distance between the first flange 120 and the second flange 126 decreases along each of the edges 122 and 128 in a direction from a broad end 130 to a narrow end 132 of the wedge 46.

In use, the form clamp 20 hereof is assembled by inserting the slider 40 between the side plates 54 and 56 such that the racks 68 and 98 are adjacent with their respective teeth 70 and 100 extending toward each other, as illustrated in regard to the lower wedge form clamp appearing the drawing of FIG. 1. The article(s) to be clamped, such as the side rails of two forming panels shown in FIG. 1, are positioned between the first jaw 40 and the second jaw 44. Where holes in the side rails are present and aligned, the locating pin 90 and anvil 52 may be inserted into the holes as shown in FIG. 4 with the first jaw 40 and the second jaw 44 clamping against the side rails of the adjacent forming panels 22 and 24, or the head and anvil may merely clamp the metal of the side rails therebetween. In order that the form clamp 20 may hold the side rails of the forming panels fast together, the wedge 46 is inserted through the windows of each of the frame 38 and the slider 42.

Figure 14:
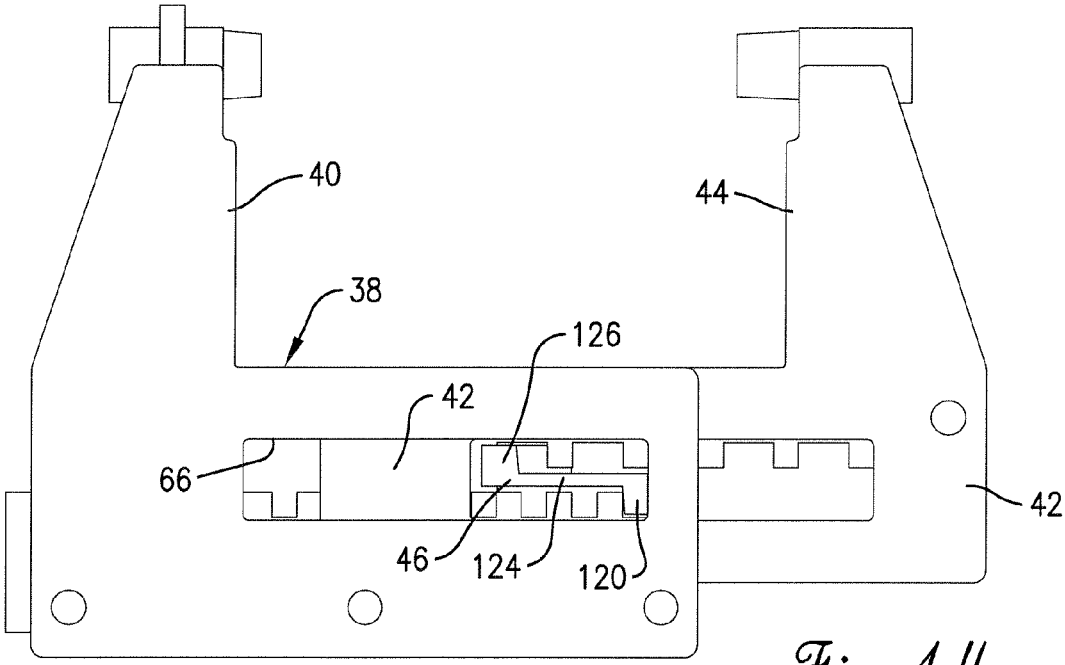
FIG. 14 is an enlarged elevational view of the wedge form clamp hereof showing the jaws in a separated position.
Figure 15:
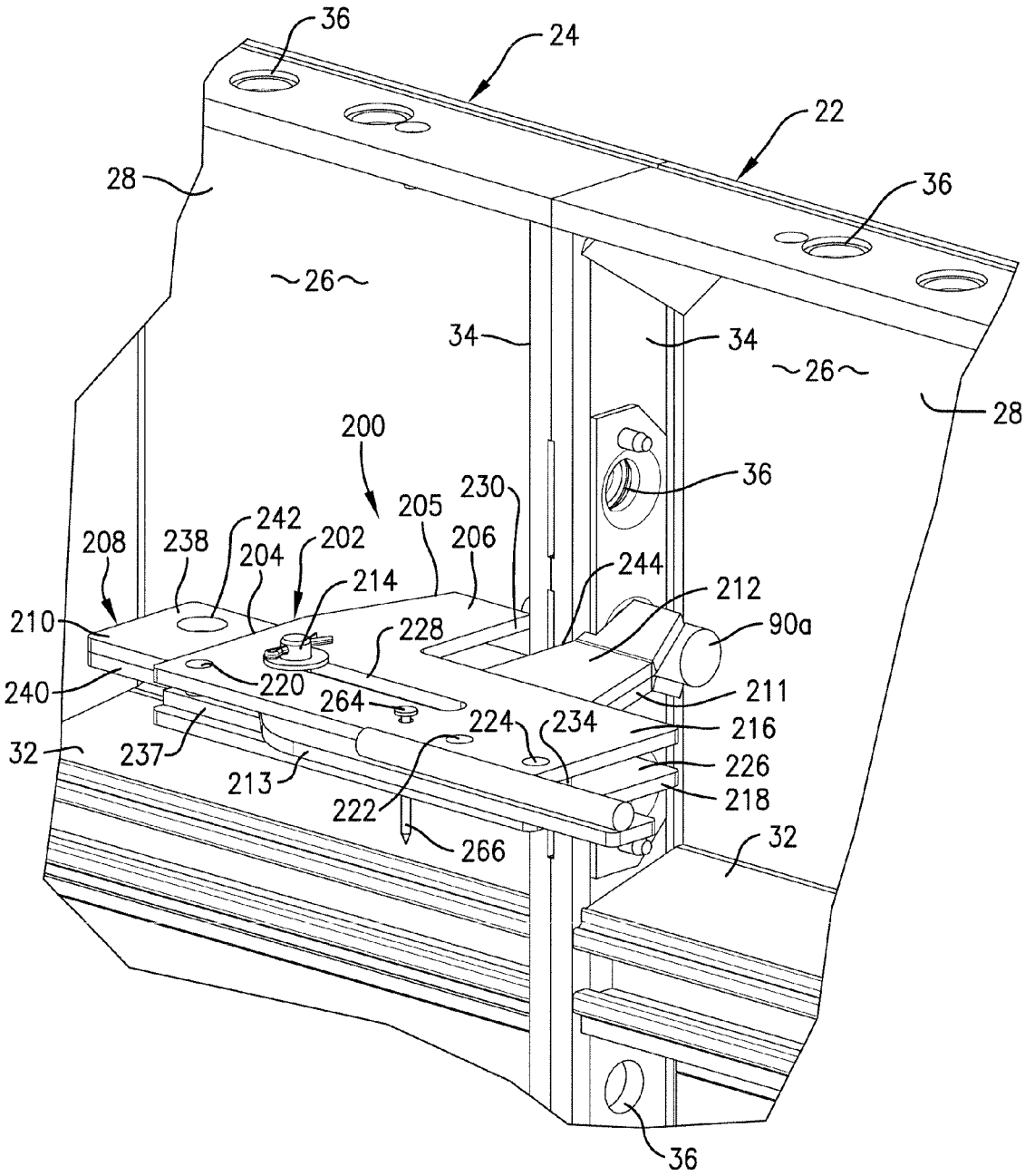
FIG. 15 is a perspective view similar to FIG. 1 but showing an alternate embodiment of the form clamp hereof in clamping engagement with two forming panels and with a locating pin received in aligned holes of the forming panels.
Figure 16:
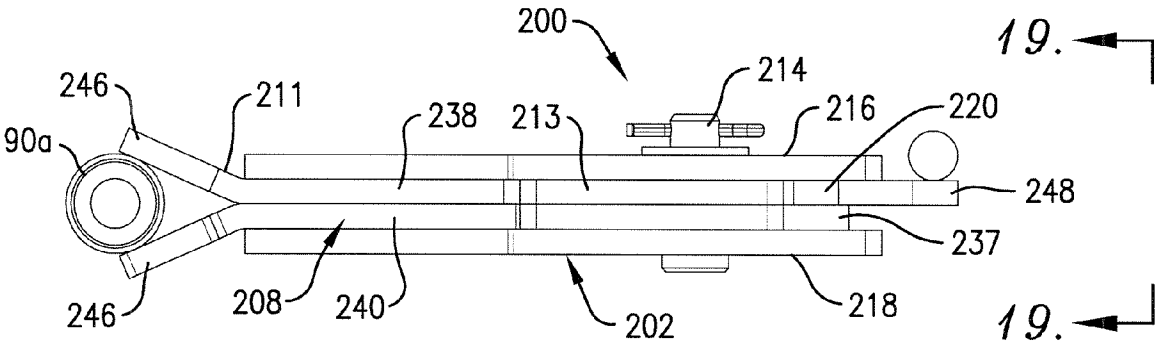
FIG. 16 is a left side view of the form clamp of FIG. 15.
Figure 19:
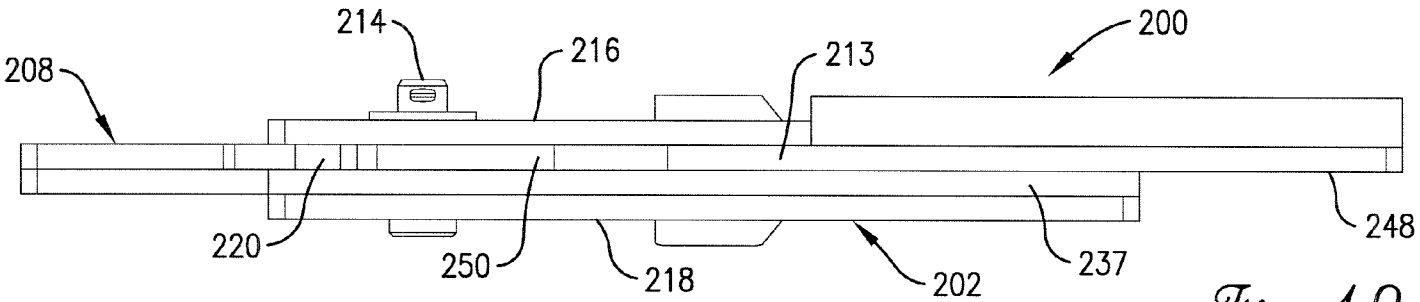
FIG. 19 is a bottom view of the form clamp of FIG. 15 taken along line 19-19 of FIG. 16.
Figure 20:
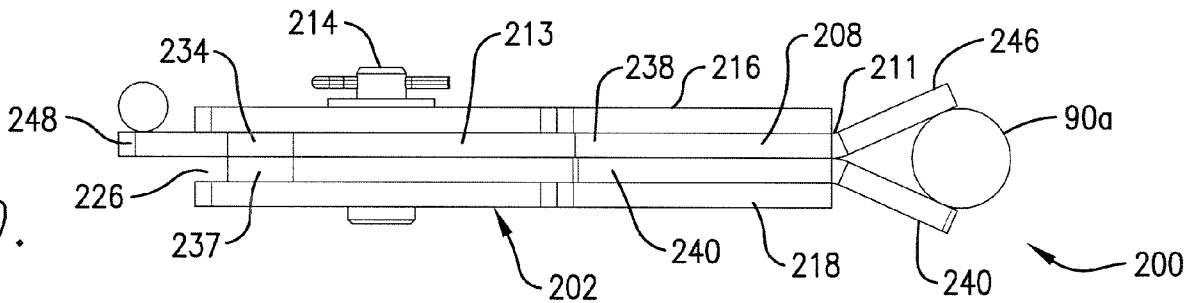
FIG. 20 is a left side view of the form clamp of FIG. 15.

Because the first flange 120 and the second flange 126 are convergent with respect to each other, when the wedge 46 is driven by a hammer or the like by striking the broad end 130 thereof, as the wedge 46 is driven, the distance between the first flange 120 and the second flange 126 increases. Surprisingly, this increase in distance between the first flange 120 and the second flange 126 causes the second rack 98 on the slider 42 to move to closer to the leg 50, and thus the distance between the anvil 52 and the head 90 to decrease. The gaps 118 are preferably larger than the gaps 116, and the second flange 126 is preferably received in one of the gaps 118. As the wedge 46 is driven, the teeth 100 on either side of the gap 118 into which the second flange is received moves along the angled flange 126, and thus the second rack 98 carries the slider 42 to the left as shown in FIGS. 4 and 14. The broad end of the wedge 46 is tapped with a hammer or similar instrument until the head or locating pin 90 and anvil 52 meet as shown in FIG. 4 or pinch a rail or other object therebetween. Thus, when the object is clamped, the engagement between the locating pin 90 and anvil 52 causes a moment arm by the respective jaws, and the wedge 46 is held by the engagement with the first rack and the second rack of the frame 38 and the slider 42.

Removal of the form clamp 20 hereof is relatively easy. By simply tapping a hammer or similar tool against the narrow end 132 of the wedge 46, the second flange 126 moves out of engagement with the second rack and the wedge 46 is easily withdrawn. Freed of the clamping force on the racks, the slider 42 is free to move along the frame 38, and the distance between the anvil 52 and head 90 increases to remove the clamping force.

A second embodiment of the form clamp 200 is shown in FIGS. 15 through 20. The form clamp 200 uses a frame 202 having a base 204 and a first leg 205 including a first jaw 206, a slider 208 having a base 210 and a second leg 21 including a second jaw 212, and a camming lever 213 which is pivotally mounted to the slider 208 by a pivot pin 214. While the form clamp 200 may include an anvil on the first leg 205 of the frame 202, this is optional and may be omitted as shown in FIGS. 15 through 20, such that the adjacent forming panels 22 and 24 are clamped only by the first jaw 206 and the second jaw 212, the locating pin 90*a* being mounted on the second leg 211.

In greater detail, the frame 202 of the form clamp 200 may be cast or forged as a one piece fabrication, or provided as two side plates 216 and 218 held together in spaced apart relationship by pins 220, 222 and 224 welded to the side plates. A gap 226 is thus provided between the side plates 216 and 218 for receiving the base 210 of the slider 208 therein. The base 204 of the frame 202, and thus the portion of each of the side plates 216 and 218 making up the base 204, includes a longitudinally extending slot 228, such that the slot 228 in each of the side plates 216 and 218 is opposite to each other and aligned. The portion of the side plates 216 and 218 making up the first jaw 212 include an engagement edge 230 which extends generally perpendicular to the slot 230. Each of the side plates 216 and 218 also includes a pinhole 232, the pinhole in the side plate 216 being opposite and generally in registry with the pinhole in the side plate 218. A boss 234 is secured to and positioned between the side plates 216 and 218 and includes a bearing shoulder 236 which is sized and positioned to engage the camming lever 213 during closure and to help hold the camming lever 213 in the closed position shown in FIG. 17. The boss 234 receives pins 222 and 224 therethough and helps, together with bar 237 which sits aside the boss 234 and extends forwardly substantially the length of the base 204, to maintain spacing between the side plates 216 and 218 in order that the slider 208 may readily shift along the gap 226 between the side plates.

The slider 208 may be fabricated by casting or forging as a single member, or alternatively as shown fabricated of two side-by-side leaves 238 and 240. The leaves 238 and 240 may be welded together by adhesives, by fasteners such as pins or rivets, by spot welding or, as illustrated, providing holes 242 and 243 in one of the leaves 238 and welding at the location of the hole 242 to the other leave 240. The portion of the leaves 238 and 240 comprising the base 210 is sized and configured for receipt in the gap 226 between the side plates 216 and 218 in order to shift longitudinally therebetween. The second jaw 212 includes an engagement edge 244 generally opposite the engagement edge 230 of the first jaw 206 for engaging a rail of one of the adjacent and generally aligned forming panels 22 and 24, such that the engagement edge 230 of the first jaw 212 engages a rail 34 of one of the forming panels 24 and the engagement edge 244 of the second jaw 212 engages the rail 34 of the other of the forming panels 22. The second leg 211, when fabricated from leaves 238 and 240, includes divergent flanges 246 to which locating pin 90*a* is secured by welding or the like. The locating pin 90*a* may be slightly longer in length than locating pin 90 of form clamp 20 as it is intended to extend through the holes 36 of each of the adjacent forming panels 22 and 24 when they are juxtaposed with their respective holes 36 in alignment.

Figure 17:
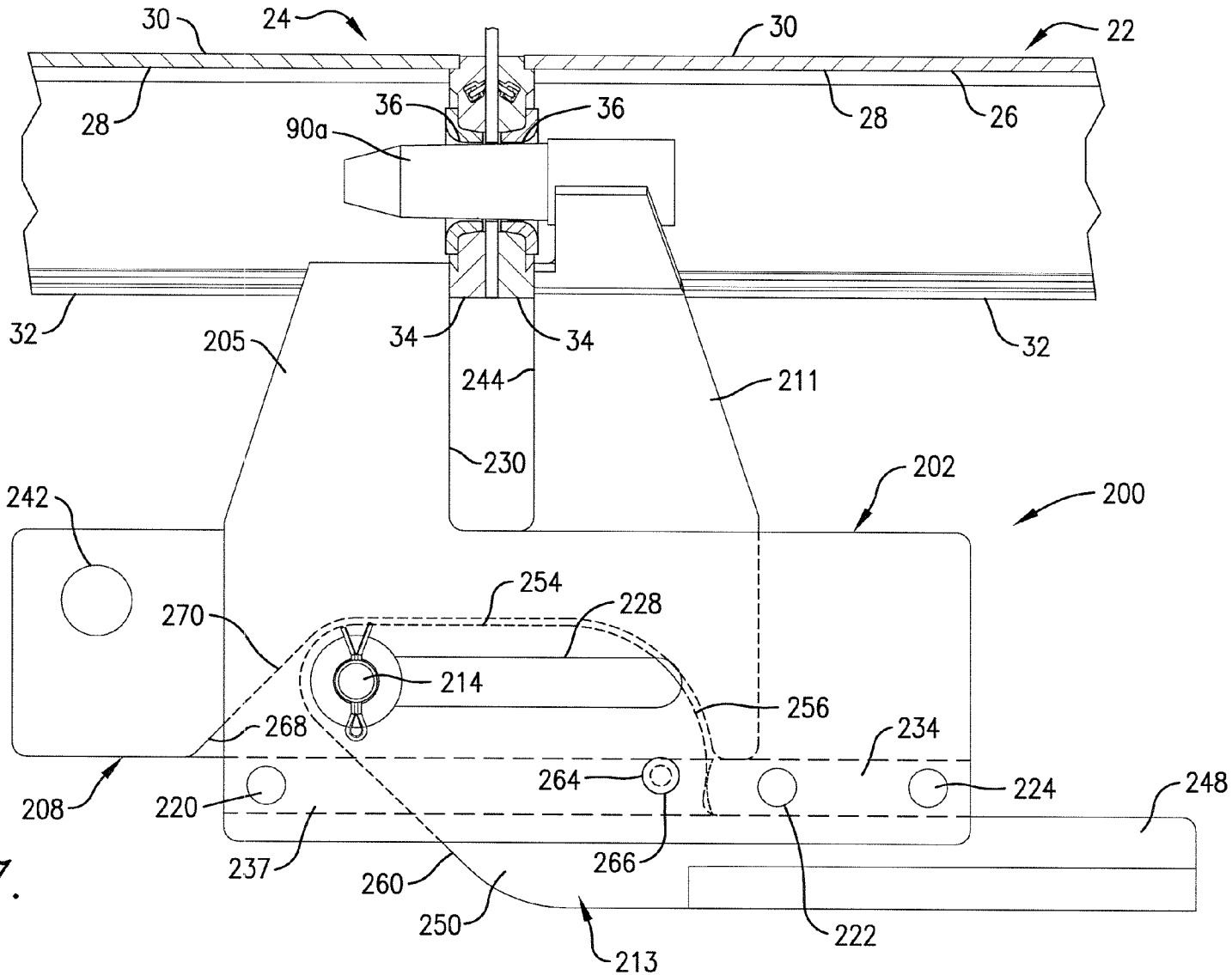
FIG. 17 is an elevational view of the form clamp of FIG. 15 shown in clamping engagement with two forming panels which are shown in cross-section, and showing the camming head of a camming lever received in a recess of the slider which are shown in broken lines.
Figure 18:
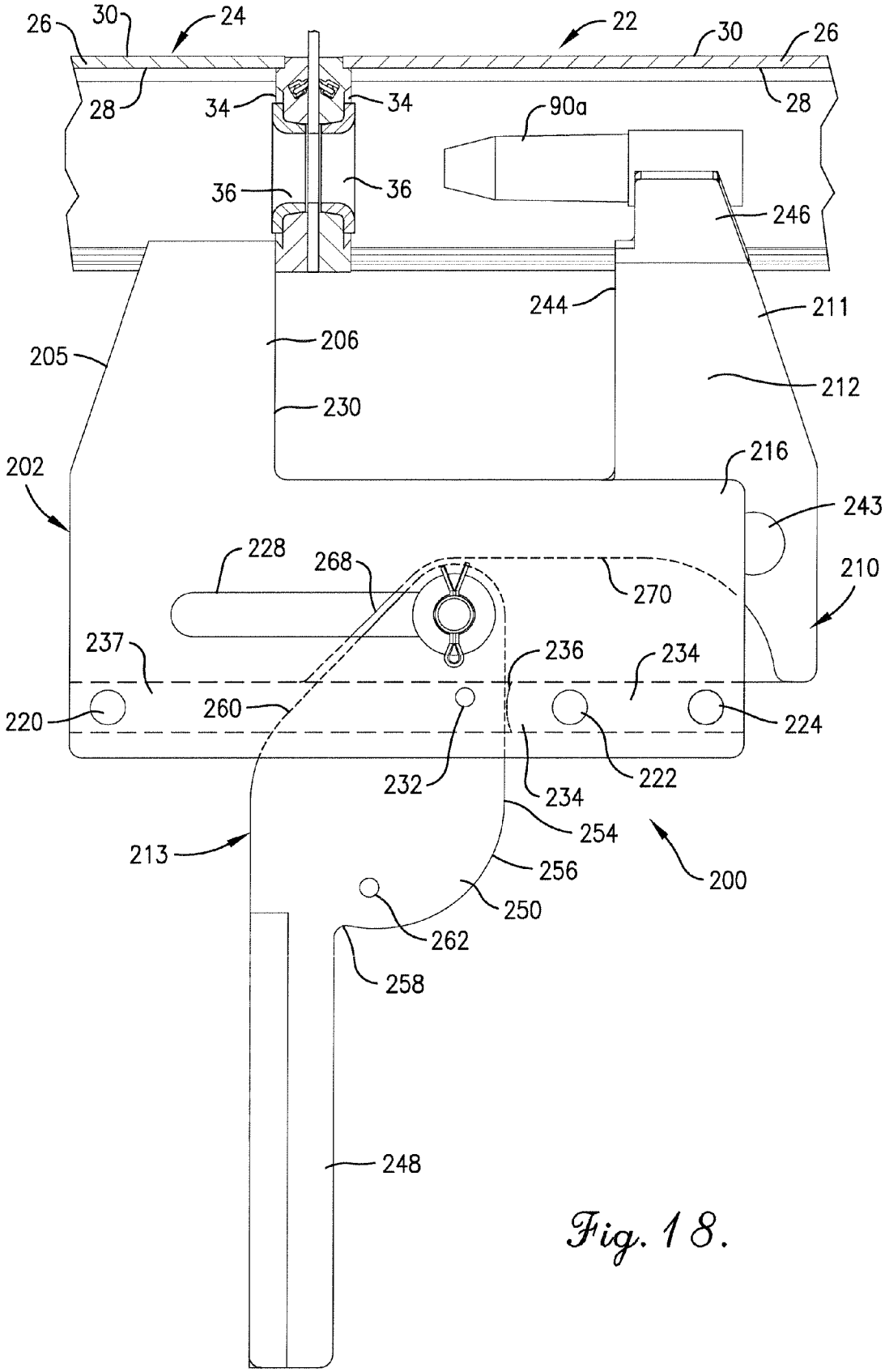
FIG. 18 is an elevational view similar to FIG. 17, but showing the slider shifted to the open position relative to the frame and the camming lever in an open and unlocked condition.

The camming lever 213 includes a lever arm 248 and a camming head 250. The camming head is shaped with a bearing edge 252 including an elongated top edge 254 and an arcuate portion 256 located rearwardly or to the right of the top edge 254 as shown in FIGS. 17 and 18, with the arcuate portion 256 include a forward return 258 proximate the lever arm 248. The camming head 250 also has a rearwardly angled forward edge 260 which inclines rearwardly toward the lever arm 248 and away from the top edge 254. The camming head 250 also includes an opening through which pivot pin 214 is received, the pivot pin 214 including washers and cotter pins or other mechanical retainers to prevent undesired dislodgement. The pivot pin also passes through the slot 228, and slides therealong, and is carried with the camming lever during closure. The camming head 250 also includes a passage 262 which is aligned with the pinhole 232 of the frame when the camming lever 213 is in the closed position as shown in FIG. 17. A retainer 264, such as a nail 266, a pin, a wire or other fastener may be inserted through the pinhole 232 and passage 262 to help hold the camming lever 213 in a closed position.

In use, camming lever 213 of the form clamp 200 is pivoted to the open position as shown in FIG. 18, with the pivot pin 214 positioned in the rearward position along the slot 228. The locating pin 90*a* is positioned in registry with the aligned holes 36 of the rails 34. A hammer or other driver may be used to drive the locating pin 90*a* into the holes. The camming lever 213 is then pivoted in a counterclockwise direction when viewed as in FIG. 18. As the camming lever 213 pivots, the bearing edge 252, beginning with the top edge 254, and then the arcuate portion 256, bears against the bearing shoulder 236 of the boss 234. During this engagement by the bearing edge 252, the pivot pin 214 shifts along the slot 230, thus also decreasing the distance between the engagement edge 230 and the engagement edge 244. When the lever arm closes to the position shown in FIG. 17, the locating pin 90*a* is substantially fully inserted into the holes 36, and the first jaw 206 and the second jaw 212, which are aligned with one another, clamp the rails of the forming panels 22 and 24 together. In this position, the shoulder 236 of the boss preferably engages the return 258 on the bearing edge 252, which helps to retain the camming lever closed. In addition, the insertion of the nail 266 through the pinhole and passage further helps to hold the form clamp 200 closed and in clamping engagement. The lever arm 248 extends rearwardly of the frame 202, whereby upon removal of the retainer 264, for example nail 266, a hammer may be used to strike the lever arm 248 and drive it in a clockwise direction as viewed in FIG. 17. When the lever arm 248 is pivoted in the clockwise direction, the forward edge 260 of the camming head subsequently engages a forward surface 268 of a recess 270 in the slider 208 which is configured to received a portion of the camming head when the latter is in the closed position as shown in FIG. 17. When the forward edge 260 engages the forward surface 268, the pivot pin 214 shifts rearwardly or to the right when viewed as in FIG. 17 along the slot 230, thereby opening the jaws. If the locating pin 90*a* remains in the holes 36, a hammer may be used to tap it out. The nail may be suspended from a chain affixed to the frame, so that all of the parts are carried together and not readily separated.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention. For example, the slider and frame may be forged or cast, rather than constructed of several leaves of materials, and may include the locating pins as a part of such casting or forging. The flanges may extend from a flat central body rather than along an edge, and the wedge may have a central body of other shapes so long as the flanges are relatively convergent.

The inventors hereby state their intent to rely on the Doctrine of Equivalents to determine and assess the reasonably fair scope of his invention as pertains to any apparatus not materially departing from but outside the literal scope of the invention as set out in the following claims.

The invention claimed is:

1. In combination:

a first forming panel having a front side adapted for receiving concrete thereagainst and a rail extending rearwardly from the first side and having a hole therein;

a second forming panel having a front side adapted for receiving concrete thereagainst and a rail extending rearwardly from the first side and having a hole therein;

a clamp adapted for clamping together the rail of the first forming panel and the second forming panel, said clamp comprising:

a frame having a base including first and second sidewalls each presenting a transverse opening therethrough and a longitudinally extending gap between said sidewalls, and a first leg extending from said base, said first leg including a first jaw;

a slider including a base shiftably received in said gap and a second leg extending from the base of the slider and having a second jaw, said second jaw being positioned in opposition to the first jaw;

at least one locating pin mounted on one of said first and second legs and configured and positioned for insertion into the holes in the rails of the first and second forming panels when the forming panels are positioned adjacent one another with their holes in substantial alignment; and a wedge for shifting said second jaw toward said first jaw in clamping engagement with said rails when positioned between said first and second jaws, at least a part of said wedge extending through said transverse opening and operable to bias said second jaw towards said first jaw, wherein said frame includes a first rack positioned between said first and second sidewalls and located proximate said transverse opening, said first rack presenting a plurality of teeth, wherein said slider includes a second rack presenting a plurality of teeth and positioned generally opposite and facing said first rack, and wherein said wedge includes a central body having a first flange extending at an angle from said central body and a second flange extending at an angle from said central body generally opposite said first flange.

2. The combination of claim 1, wherein the spacing between the teeth of the first rack is different from the spacing between the teeth of the second rack, and wherein the first flange is oriented on a first plane and said second flange is oriented on a second plane convergent with said first plane.

3. The combination of claim 1, wherein a locating pin is mounted on each of said first leg and said second leg.

4. A form clamp for releasably coupling first and second adjacent forming panels for concrete, said form clamp comprising:

a frame having a base including first and second sidewalls each presenting a transverse opening therethrough and a longitudinally extending gap between said sidewalls, and a first leg including a first jaw extending from said base;

a slider including a base shiftably received in said gap and including a leg including a second jaw extending from the base of the slider in opposition to the first jaw;

at least one locating pin mounted on one of said first and second legs in spaced relationship to the respective base; and a wedge for biasing said second jaw toward said first jaw, at least a part of said wedge extending through said transverse opening, wherein said frame includes a first rack positioned between said first and second sidewalls and located proximate said transverse opening, said first rack presenting a plurality of teeth, wherein said slider includes a second rack presenting a plurality of teeth and positioned generally opposite and facing said first rack, and wherein said wedge includes a central body having a first flange extending at an angle from said central body and a second flange extending at an angle from said central body generally opposite said first flange.

5. The combination of claim 4, wherein the spacing between the teeth of the first rack is different from the spacing between the teeth of the second rack, and wherein the first flange is oriented on a first plane and said second flange is oriented on a second plane convergent with said first plane.

6. The combination of claim 4, wherein a locating pin is mounted on each of said first leg and said second leg.

7. A method of clamping adjacent first and second forming panels each having a front side adapted for receiving concrete thereagainst and a rearwardly extending rail having a hole therethrough, said method comprising the steps of:

positioning said forming panels with their respective side rails in side-by-side juxtaposition with their respective holes in substantial alignment;

providing a form clamp including a frame having a base including first and second sidewalls each presenting a transverse opening therethrough and a longitudinally extending gap between said sidewalls, and a first leg including a first jaw extending from said base, a slider having a base shiftably received in said gap and including a leg including a second jaw extending from the base of the slider in opposition to the first jaw, said slider being shiftably received in said frame, at least one of said frame and said slider including a locating pin mounted on one of said first and second legs in spaced relationship to the respective base and adapted for insertion into said aligned holes, and a wedge for biasing said second jaw toward said first jaw, wherein said frame includes a first rack positioned between the first and second sidewalls and located proximate the transverse opening, said first rack presenting a plurality of teeth, wherein said slider includes a second rack presenting a plurality of teeth and positioned generally opposite and facing said first rack, and wherein said wedge includes a central body having a first flange extending at an angle from said central body and a second flange extending at an angle from said central body generally opposite said first flange;

inserting said locating pin into said holes;

shifting said slider to place said rails of said first and second forming panels in engagement with one another; and inserting said wedge at least partially into the transverse opening and in engagement with said first rack and said second rack and thereby exerting a clamping force between said frame and said slider to clamp said rails together.

* * * * *